US007049799B2

(12) United States Patent
Sugiura

(10) Patent No.: US 7,049,799 B2
(45) Date of Patent: May 23, 2006

(54) VOLTAGE REGULATOR AND ELECTRONIC DEVICE

(75) Inventor: Masakazu Sugiura, Chiba (JP)

(73) Assignee: Seiko Instruments Inc., Chiba (JP)

( * ) Notice: Subject to any disclaimer, the term of this patent is extended or adjusted under 35 U.S.C. 154(b) by 199 days.

(21) Appl. No.: 10/712,145

(22) Filed: Nov. 13, 2003

(65) Prior Publication Data

US 2004/0113595 A1 Jun. 17, 2004

(30) Foreign Application Priority Data

Nov. 14, 2002 (JP) ..... 2002-330846

(51) Int. Cl.
*G05F 1/40* (2006.01)

(52) U.S. Cl. ..... 323/282

(58) Field of Classification Search ..... 323/268, 323/270, 271, 273, 275, 280, 281, 282, 285, 323/299, 303
See application file for complete search history.

(56) References Cited

U.S. PATENT DOCUMENTS 4,731,574 A * 3/1988 Melbert ..... 323/275
5,828,206 A * 10/1998 Hosono et al. ..... 323/273
5,945,819 A * 8/1999 Ursino et al. ..... 323/282
6,617,833 B1 * 9/2003 Xi ..... 323/282
2002/0093322 A1 * 7/2002 Marty et al. ..... 323/282
2004/0130305 A1 * 7/2004 Agari et al. ..... 323/282

* cited by examiner

*Primary Examiner*—Matthew V. Nguyen
(74) *Attorney, Agent, or Firm*—Adams & Wilks

(57) ABSTRACT

A voltage regulator has a reference voltage circuit, a voltage source, an output terminal from which an output voltage is outputted in accordance with a voltage of the voltage source, and a voltage dividing circuit for dividing the output voltage of the output terminal. An error amplified outputs a signal in accordance with an output of the voltage dividing circuit and an output of the reference voltage circuit. An output transistor is connected between the voltage source and the voltage dividing circuit and is ON/OFF-controlled in accordance with the signal outputted from the error amplifier. A current adding circuit controls an operating current of the error amplifier in accordance with the output voltage of the output terminal and the voltage of the voltage source by increasing the operating current of the error amplifier when the output voltage of the output terminal is higher than a predetermined value.

9 Claims, 2 Drawing Sheets

VOLTAGE REGULATOR AND ELECTRONIC DEVICE

BACKGROUND OF THE INVENTION

1. Field of the Invention

The present invention relates to a voltage regulator (hereinafter referred to as V/R) capable of improving an overshoot characteristic of the V/R. The present invention also relates to an electronic device equipped with the voltage regulator.

2. Description of the Related Art

As shown in a circuit diagram of FIG. 3, a conventional V/R includes: a V/R control circuit composed of an error amplifier 13 that amplifies a differential voltage between a reference voltage Vref1 of a reference voltage circuit 10 and a voltage at a connection point of bleeder resistors 11 and 12 that divide a voltage (hereinafter referred to as an output voltage) Vout at an output terminal 6 of the V/R; and an output MOS transistor 14. The V/R operates according to a voltage (hereinafter referred to as VDD1) supplied from a voltage source 15. Assuming that an output voltage of the error amplifier 13 is given by Verr and a voltage at the connection point of the bleeder resistors 11 and 12 is given by Va, if Vref1>Va is established, Verr becomes lower. On the other hand, if Vref1<Va is established, Verr becomes higher.

If Verr becomes lower, because the output MOS transistor 14 is a P-ch MOS transistor in this case, a voltage between a gate and a source thereof becomes larger and an ON resistance becomes smaller, so that the V/R functions to raise the output voltage Vout. On the other hand, if Verr becomes higher, the V/R functions to increase the ON resistance of the output transistor 14 and to reduce the output voltage, thereby keeping the output voltage Vout at a fixed value (for example, see JP 04-195613 A (pages 1 to 3 and FIG. 2)).

Although not shown here, it is generally known that a phase compensating capacitor needs to be suitably added to the V/R if necessary.

Also, it is generally known that, for example, as shown in FIG. 4, the error amplifier 13 of the V/R includes: a current mirror circuit composed of a P-ch MOS transistor 16 and a P-ch MOS transistor 17; an input differential pair composed of an N-ch MOS transistor 18 and an N-ch MOS transistor 19; and a constant current circuit 20 into which a constant current 11 flows.

However, in the conventional V/R, an operating current of the error amplifier 13 is determined by a constant current circuit 20. Therefore, there arises the following problem. If a current flowing into the constant current circuit 20 is reduced in order to realize a V/R having low current consumption, when the power source is started, that is, when VDD1 is provided as a pulse signal, or when a load connected with the output terminal 6 of the V/R is suddenly reduced, the output voltage Vout largely tends to exhibit an overshoot characteristic. In other words, a power source start characteristic is sacrificed. On the other hand, if a current flowing into the constant current circuit 20 is increased in order to realize a V/R having an improved overshoot characteristic, the low current consumption characteristic is sacrificed.

When a battery is used as the power source, the low current consumption characteristic is required to lengthen a life of the battery. On the other hand, with regard to the overshoot characteristic of the output voltage Vout of the V/R, it is necessary to avoid a state in which the output voltage becomes equal to or larger than a withstanding voltage of an external element connected with the output terminal of the V/R.

When the overshoot characteristic of the V/R is improved, for the purpose of achieving a wide band of the error amplifier 13, it is basically unavoidable to increase the operating current of the error amplifier 13. However, when the battery is used as the power source, it is essential to obtain the low current consumption characteristic. Accordingly, in the current state, it is not acceptable to increase the current consumption of the V/R itself.

SUMMARY OF THE INVENTION

Therefore, the present invention has been made to solve the foregoing problems in the conventional art. An object of the present invention is to control, only in the case where a voltage to which an output voltage Vout is to be controlled is higher than a desirable value, an operating current of an error amplifier composing a V/R to a temporarily large value to achieve a wide band of the error amplifier, thereby improving an overshoot characteristic, and to control, in cases other than the abovementioned case, the operating current of the error amplifier composing the V/R to a small value to achieve a reduction in current consumption.

In order to achieve the above object, according to the present invention, there is provided a voltage regulator including:

a reference voltage circuit;

a voltage source;

an output terminal from which an output voltage is outputted in accordance with a voltage of the voltage source, a voltage dividing circuit that divides the output voltage;

an error amplifier that outputs a signal in accordance with an output of the voltage dividing circuit and an output of the reference voltage circuit;

an output transistor that is connected between the voltage source and the voltage dividing circuit and ON/OFF-controlled in accordance with the signal outputted from the error amplifier; and a current adding circuit that controls an operating current of the error amplifier in accordance with the output voltage of the output terminal and the voltage of the voltage source.

Further, the current adding circuit increases the operating current of the error amplifier when the output voltage of the output terminal is higher than a predetermined value.

Further, according to the present invention, there is provided an electronic device including the above-mentioned voltage regulator.

DETAILED DESCRIPTION OF THE PREFERRED EMBODIMENT

Figure 1:
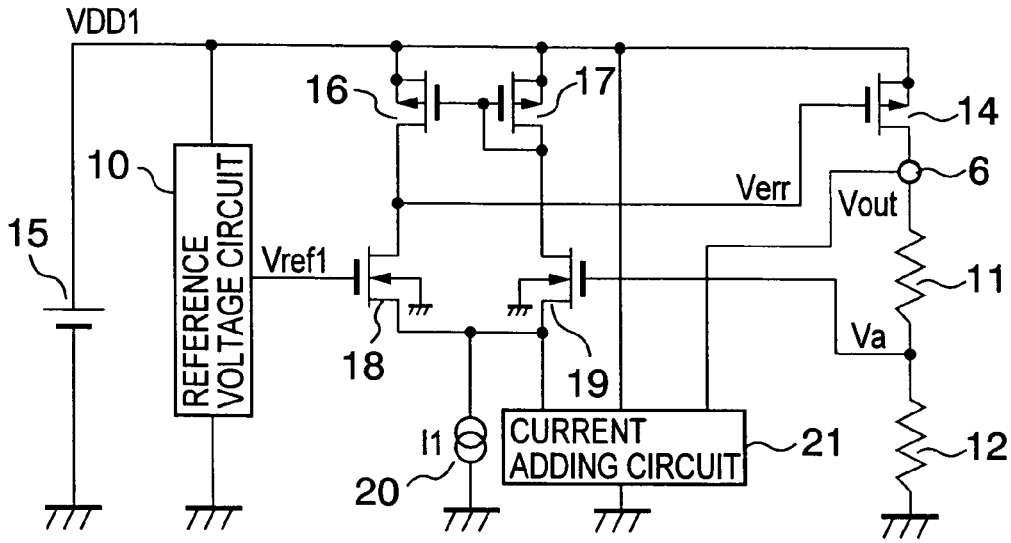
FIG. 1 is an explanatory circuit diagram of a voltage regulator showing Embodiment 1 of the present invention.
Figure 4:
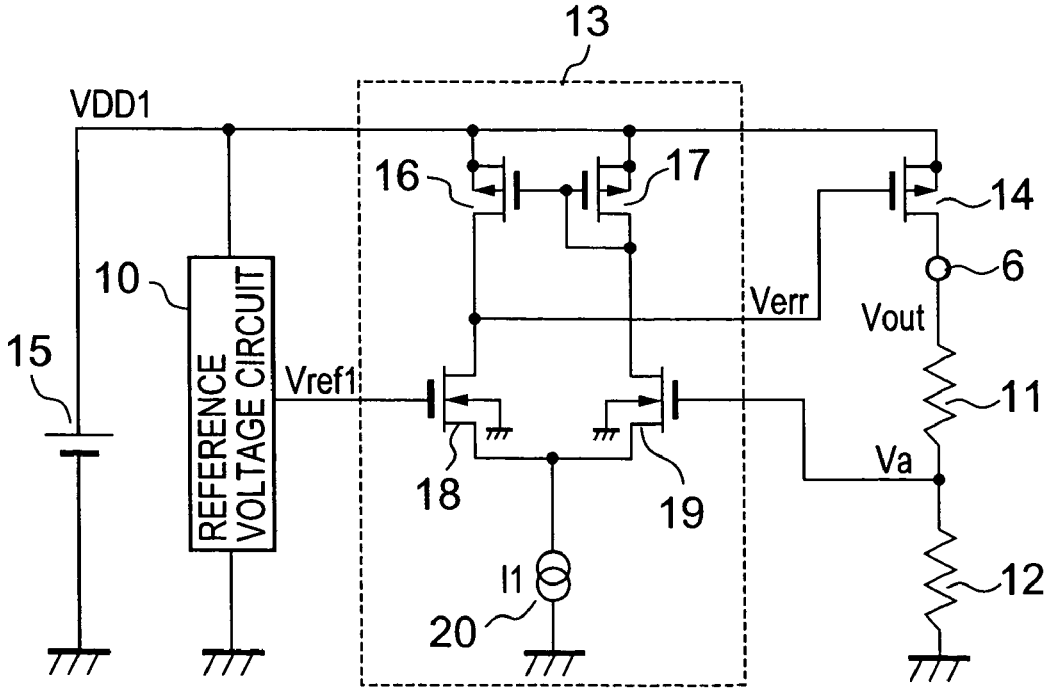
FIG. 4 PRIOR ART
FIG. 4 is an explanatory circuit diagram of the conventional voltage regulator.

Hereinafter, an embodiment of the present invention will be described with reference to the drawings. FIG. 1 is a circuit diagram of a V/R showing Embodiment 1 of the present invention. FIG. 1 is distinguished from FIG. 4 in that a current adding circuit 21 is provided. The current adding circuit 21 acts to increase the operating current of an error amplifier in a state in which it is detected that a voltage to which an output voltage Vout is to be controlled is higher than a predetermined or desirable value.

Figure 2:
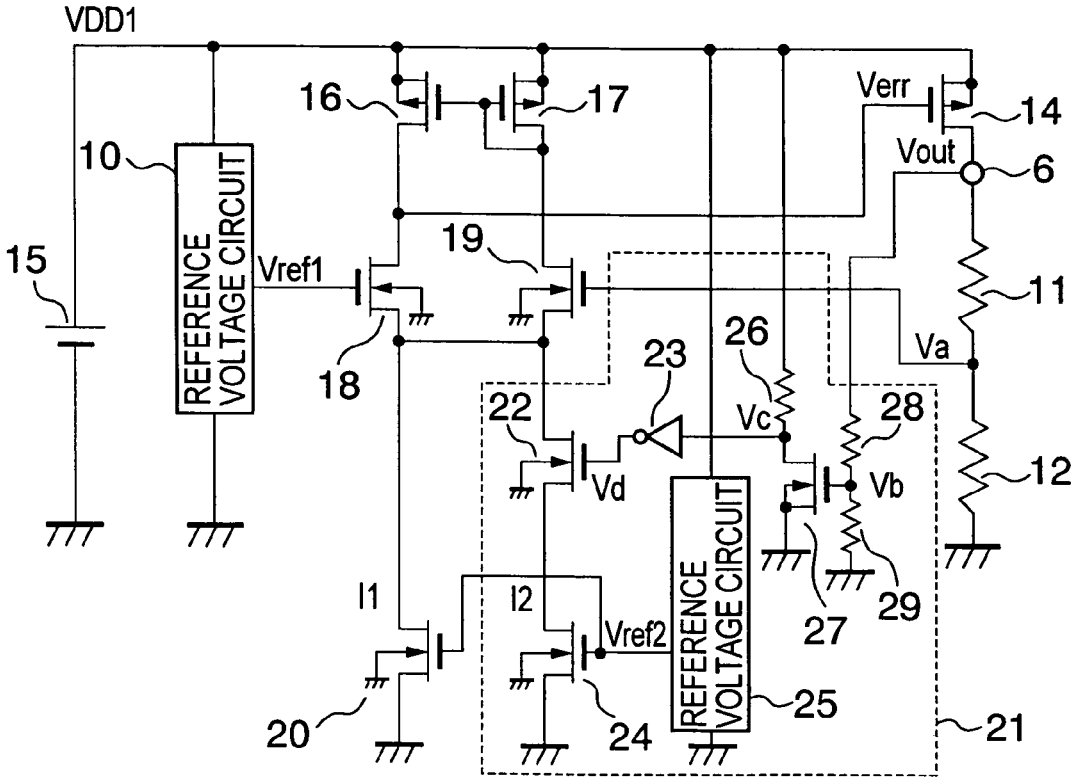
FIG. 2 is an explanatory circuit diagram of the voltage regulator showing Embodiment 1 of the present invention.
Figure 3:
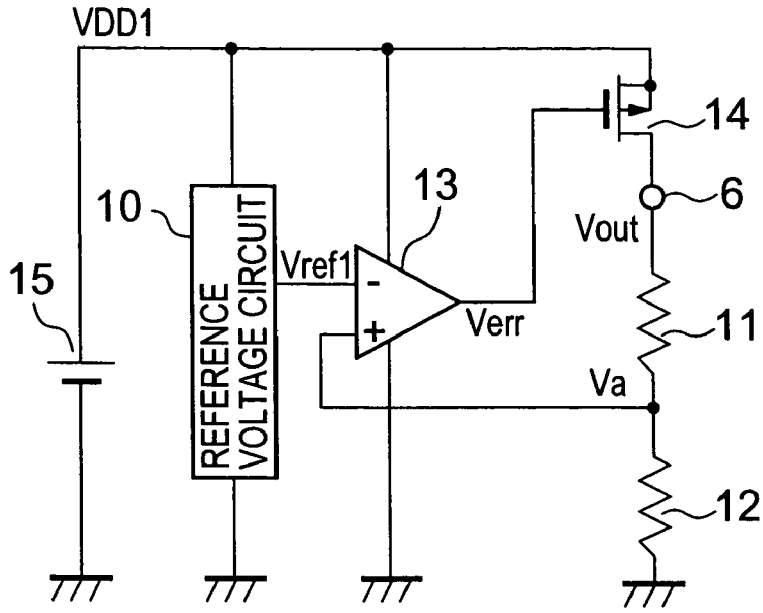
FIG. 3 PRIOR ART
FIG. 3 is an explanatory circuit diagram of a conventional voltage regulator.

For example, as shown in FIG. 2, the current adding circuit 21 includes: a bleeder resistor 28 and a bleeder resistor 29 that divide the output voltage Vout; an N-ch MOS transistor 27 that is ON/Off-controlled by a voltage Vb at a connection point between the bleeder resistor 28 and the bleeder resistor 29; a resistor 26 for pulling up a voltage in a drain of the N-ch MOS transistor 27; an inverter 23 to which a voltage Vc at a connection point between the drain of the N-ch MOS transistor 27 and an end of the resistor 26 is inputted; an N-ch MOS transistor 22 that is ON/Off-controlled by an output voltage Vd of the inverter 23; a reference voltage circuit 25 that outputs a voltage Vref2; and an N-ch MOS transistor 24 in which the voltage Vref2 is applied to a gate thereof. In FIG. 2, the current adding circuit 21 corresponds to an area surrounded by a dotted line. Note that, in FIG. 2, a constant current circuit 20 corresponds to the N-ch MOS transistor in which the voltage Vref2 is applied to the gate thereof.

As described above, the potential at the connection point between the bleeder resistor 28 and the bleeder resistor 29 that divide the output voltage Vout is Vb. Therefore, when the output voltage Vout is increased and Vb reaches a voltage for turning ON the N-ch MOS transistor 27, the voltage Vc becomes lower (hereinafter referred to as "L") by voltage drop produced in the resistor 26. On the other hand, when the output voltage Vout is reduced and Vb reaches a voltage for turning OFF the N-ch MOS transistor 27, the voltage Vc becomes higher (hereinafter referred to as "H").

When Vc is "L", the output voltage Vd of the inverter 23 to which such Vc is inputted becomes "H", thereby turning ON the N-ch MOS transistor 22. Accordingly, a drain current I2 flows into the N-ch MOS transistor 24 in which the voltage Vref2 is applied to the gate thereof, so that the operating current of the error amplifier is increased by the drain current amount.

On the other hand, when Vc is "H", the output voltage Vd of the inverter 23 to which such Vc is inputted becomes "L", thereby turning OFF the N-ch MOS transistor 22. Accordingly, the drain current does not flow into the N-ch MOS transistor 24 in which the voltage Vref2 is applied to the gate thereof, so that the operating current of the error amplifier becomes only a current I1 from the constant current circuit 20. The output voltage Vout by which Vb causes the N-ch MOS transistor 27 to be turned ON or OFF can be set by suitably providing resistance values of the bleeder resistor 28 and the bleeder resistor 29. Accordingly, when it is detected that a voltage to which the output voltage Vout is to be controlled is higher than a desirable value, the operating current of the error amplifier can be increased.

Therefore, only in the case where the voltage to which the output voltage Vout is to be controlled is higher than the desirable value, the operating current of the error amplifier composing the V/R is controlled to a temporarily large value to achieve a wide band of the error amplifier, thereby improving an overshoot characteristic. In cases other than the above-mentioned case, the operating current of the error amplifier composing the V/R is controlled to a small value to achieve a reduction in current consumption. In the conventional V/R, the operating current of the error amplifier 13 is determined by the constant current circuit 20. Accordingly, there arises the following problem. If the current flowing into the constant current circuit 20 is reduced in order to realize the V/R having the low current consumption, when the power source is started, that is, when VDD1 is provided as a pulse signal, or when a load connected with the output terminal 6 of the V/R is suddenly reduced, the output voltage Vout largely tends to exhibit the overshoot characteristic. In other words, a power source start characteristic is sacrificed. On the other hand, if the current flowing into the constant current circuit 20 is increased in order to realize the V/R having the improved overshoot characteristic, the low current consumption characteristic is sacrificed. Thus, the above-mentioned problem can be solved.

According to the above description, Vref2 is applied to the gate of the N-ch MOS transistor composing the constant current circuit 20 and the gate of the N-ch MOS transistor 24. However, when Vref3 is newly provided, Vref2 and Vref3 are separately applied, and Vref2 and Vref3 are set to arbitrary values, an effect can be obtained that the current increased by the current adding circuit 21 is variable and can be arbitrarily set.

Also, in the above description, when the bleeder resistor 28 and the bleeder resistor 29 are used as variable resistors, a lower limit value of the output voltage Vout for controlling the operating current of the error amplifier composing the V/R to a temporarily large value is variable and can be arbitrarily set.

Also, according to the above description, the current adding circuit 21 includes the structure as shown in FIG. 2. However, even when the current adding circuit 21 includes another structure capable of having the same function as in FIG. 2, the same effect can be obtained.

Thus, as described above, according to the voltage regulator of the present invention, the circuit that increases the operating current of the error amplifier when it is detected that the voltage to which the output voltage is to be controlled is higher than a desirable value is provided. Accordingly, only in the case where the voltage for controlling the output voltage is higher than the desirable value, the operating current of the error amplifier composing the V/R can be controlled to a temporarily large value to achieve a wide band of the error amplifier, thereby improving an overshoot characteristic. In cases other than the above-mentioned case, the operating current of the error amplifier composing the V/R can be controlled to a small value to achieve a reduction in current consumption.

Further, depending on a structure of the circuit that increases the operating current of the error amplifier when it is detected that the voltage to which the output voltage is to be controlled is higher than the desirable value, the current increased by the circuit that increases the operating current of the error amplifier is variable and can be arbitrarily set.

Further, depending on a structure of the circuit that increases the operating current of the error amplifier when it is detected that the voltage to which the output voltage is to be controlled is higher than the desirable value, the voltage detected by the circuit that increases the operating current of the error amplifier is variable and can be arbitrarily set.

Furthermore, an electronic device according to the present invention includes the above-mentioned voltage regulator. Thus, a reduction in power consumption is possible.

What is claimed is:

1. A voltage regulator comprising:

a reference voltage circuit;

a voltage source;

an output terminal from which an output voltage is outputted in accordance with a voltage of the voltage source;

a voltage dividing circuit for dividing the output voltage of the output terminal;

an error amplifier for outputting a signal in accordance with an output of the voltage dividing circuit and an output of the reference voltage circuit;

an output transistor connected between the voltage source and the voltage dividing circuit and ON/OFF-controlled in accordance with the signal outputted from the error amplifier; and a current adding circuit for controlling an operating current of the error amplifier in accordance with the output voltage of the output terminal and the voltage of the voltage source by increasing the operating current of the error amplifier when the output voltage of the output terminal is higher than a predetermined value.

2. An electronic device comprising the voltage regulator according to claim 1.

3. A voltage regulator according to claim 1; wherein the current adding circuit comprises a pair of bleeder resistors for dividing the output voltage, a first N-MOS transistor ON/OFFcontrolled by as voltage at a connection point between the bleeder resistors, a resistor for raising a voltage in a drain of the first NMOS transistor, an inverter to which a voltage at a connection point between the drain of the first N-MOS transistor and an end of the resistor is inputted, a second N-NOS transistor ON/OFF-controlled by an output voltage of the inverter, and a third N-MOS transistor having a gate to which a reference voltage is applied.

4. A voltage regulator according to claim 1; wherein the current adding circuit controls the operating current of the error amplifier to a temporary large value only when the output voltage of the output terminal is higher than the predetermined value.

5. A voltage regulator comprising:

a reference voltage circuit;

a voltage source;

an output terminal from which an output voltage is outputted in accordance with a voltage of the voltage source;

a voltage dividing circuit for dividing the output voltage of the output terminal;

an error amplifier for outputting a signal in accordance with an output of the voltage dividing circuit and an output of the reference voltage circuit; and control means for controlling an operating current of the error amplifier to a temporary large value only in a case when the output voltage of the output terminal is higher than a predetermined value.

6. A voltage regulator according to claim 5; further comprising an output transistor connected between the voltage source and the voltage dividing circuit and ON/OFF-controlled in accordance with the signal outputted from the error amplifier.

7. A voltage regulator according to claim 5; wherein the control means comprises a current adding circuit having a pair of bleeder resistors for dividing the output voltage, a first N-MOS transistor ON/OFF-controlled by as voltage at a connection point between the bleeder resistors, a resistor for raising a voltage in a drain of the first N-MOS transistor, an inverter to which a voltage at a connection point between the drain of the first N-MOS transistor and an end of the resistor is inputted, a second NMOS transistor ON/OFF-controlled by an output voltage of the inverter, and a third N-MOS transistor having a gate to which a reference voltage is applied.

8. A voltage regulator according to claim 5; wherein the control means includes means for controlling, in cases other than when the output voltage of the output terminal is higher than the predetermined value, the operating current of the error amplifier to a small value to achieve a reduction in power consumption of the voltage regulator.

9. An electronic device comprising the voltage regulator according to claim 5.

* * * * *